US007252504B2

(12) United States Patent
Lin

(10) Patent No.: US 7,252,504 B2
(45) Date of Patent: Aug. 7, 2007

(54) SECURE AND CONVENIENT IGNITER

(76) Inventor: Arlo Lin, Akara Building, 24 De Castro Street, Wickhams Cay I, Road Town, Tortola (VG)

( * ) Notice: Subject to any disclaimer, the term of this patent is extended or adjusted under 35 U.S.C. 154(b) by 20 days.

(21) Appl. No.: 11/163,106

(22) Filed: Oct. 5, 2005

(65) Prior Publication Data

US 2006/0216664 A1 Sep. 28, 2006

(30) Foreign Application Priority Data

Mar. 24, 2005 (TW) ..... 94109038 A

(51) Int. Cl.
*F23D 11/36* (2006.01)

(52) U.S. Cl. ..... 431/153

(58) Field of Classification Search ..... 431/153, 431/255, 345, 344; 40/70.06
See application file for complete search history.

(56) References Cited

U.S. PATENT DOCUMENTS 5,355,768 A * 10/1994 Felk ..... 89/147
6,086,359 A * 7/2000 Sher ..... 431/153
6,168,423 B1 * 1/2001 Man ..... 431/344
2003/0213159 A1 * 11/2003 Cutini et al. ..... 42/70.06

OTHER PUBLICATIONS

Taiwanese Patent Publication No. 587676, May 11, 2004, 8 pages.

* cited by examiner

*Primary Examiner*—Ken Rinehart
*Assistant Examiner*—Sarah E. Suereth
(74) *Attorney, Agent, or Firm*—Alan Kamrath; Kamrath & Associates PA

(57) ABSTRACT

A secure and convenient igniter includes a trigger and a security element. The trigger is pivotally connected to the igniter for actuation of the igniter. The security element is pivotally connected to the igniter so that the security element normally locks the trigger and can be pivoted in order to set the trigger free for pivotal movement. Pivotal movement of the security element and pivotal movement of the trigger can be done in a smooth sequence.

12 Claims, 5 Drawing Sheets

SECURE AND CONVENIENT IGNITER

BACKGROUND OF INVENTION

1. Field of Invention

The present invention relates to an igniter for igniting gas and, more particularly, to a secure and convenient igniter.

2. Related Prior Art

As disclosed in Taiwanese Patent Publication No. 587676, an igniter includes a shell 10, an igniting element 20, a security element 30 and a button cover 40. The igniting element 20 is installed in the shell 10. The igniting element 20 includes a button 21 that can be pushed in order to actuate the igniting element 20. The button cover 40 is attached to the button 21 on a side and exposed from the shell 10 on another side so that the button cover 40 and the button 21 can be pushed in order to actuate the igniting element 20. The security element 30 is pivotally connected to the shell 10. The security element 30 includes a hook 32. Between the security element 30 and the shell 10 is a spring 35 for keeping the hook 32 hooking the button cover 40 so that the button cover 40 and the button 21 cannot be pushed. The security element 30 can be pivoted in order to release the button cover 40 from the hook 32 so that the button cover 40 and the button 21 can be pushed.

The security element 30 provides security; however, it entails inconvenience that is almost unbearable. A user has to pivot the security element 30 with a finger and then slide the finger to the button cover 40 in order to ignite. However, as often happens, before the user reaches the button cover 40, the spring 35 springs the security element 30 back so that the hook 32 hooks the button cover 40 and hinders the pushing of the button cover 40. This is inconvenient. Alternatively, the user may pivot the security element 30 with a finger and push the button cover 40 with another finger. This is also inconvenient.

The present invention is therefore intended to obviate or at least alleviate the problems encountered in the prior art.

SUMMARY OF INVENTION

According to the present invention, a secure and convenient igniter includes a trigger and a security element. The trigger is pivotally connected to the igniter for actuation of the igniter. The security element is pivotally connected to the igniter so that the security element normally locks the trigger and can be pivoted in order to set the trigger for pivotal movement. Pivotal movement of the security element and pivotal movement of the trigger can be done in a smooth sequence.

The primary advantage of the igniter of the present invention is its secure and convenient nature.

Other advantages and novel features of the present invention will become more apparent from the following detailed description referring to the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
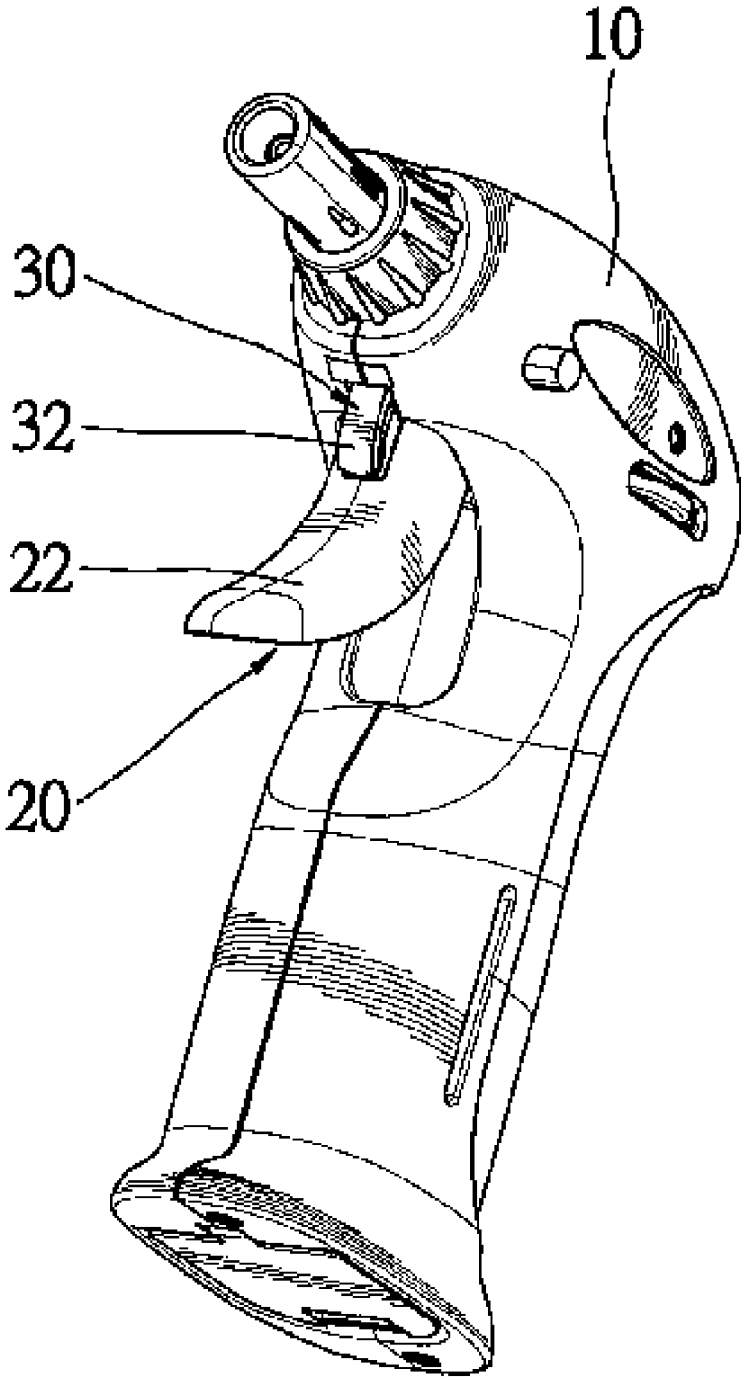
FIG. 1 is a perspective view of a secure and convenient igniter according to the preferred embodiment of the present invention.

Referring to FIG. 1, a secure and convenient igniter 10 includes a trigger 20 and a security element 30. Both the trigger 20 and the security element 30 are pivotally connected to the igniter 10. Normally, the security element 30 locks the trigger 20 so that pivotal movement of the trigger 20 is avoided, i.e., the actuation of the igniter 10 is avoided. The security element 30 can be pivoted toward the trigger 20 so that the trigger 20 can be operated in order to actuate the igniter 10.

Figure 2:
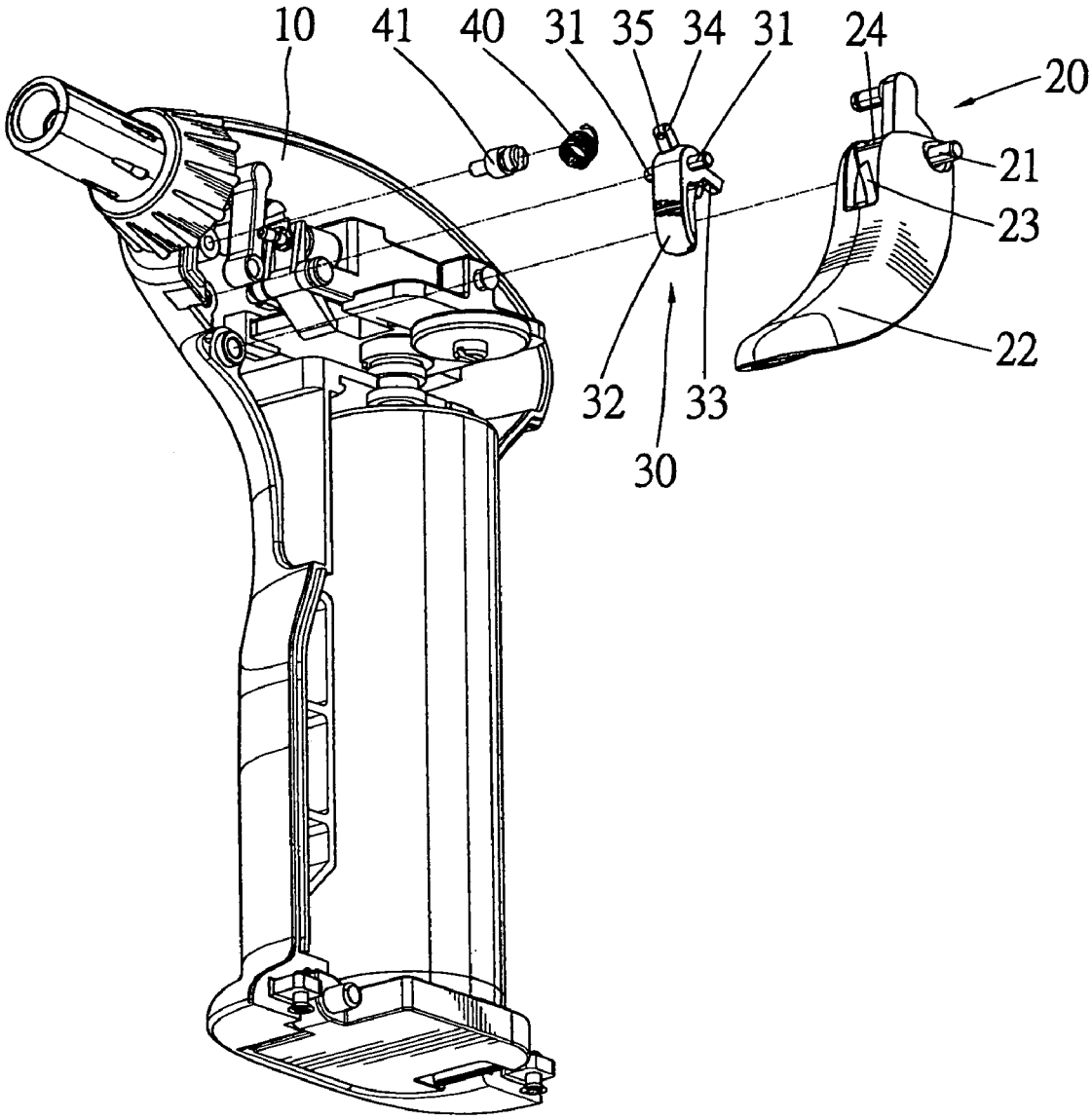
FIG. 2 is an exploded view of the igniter shown in FIG. 1.
Figure 3:
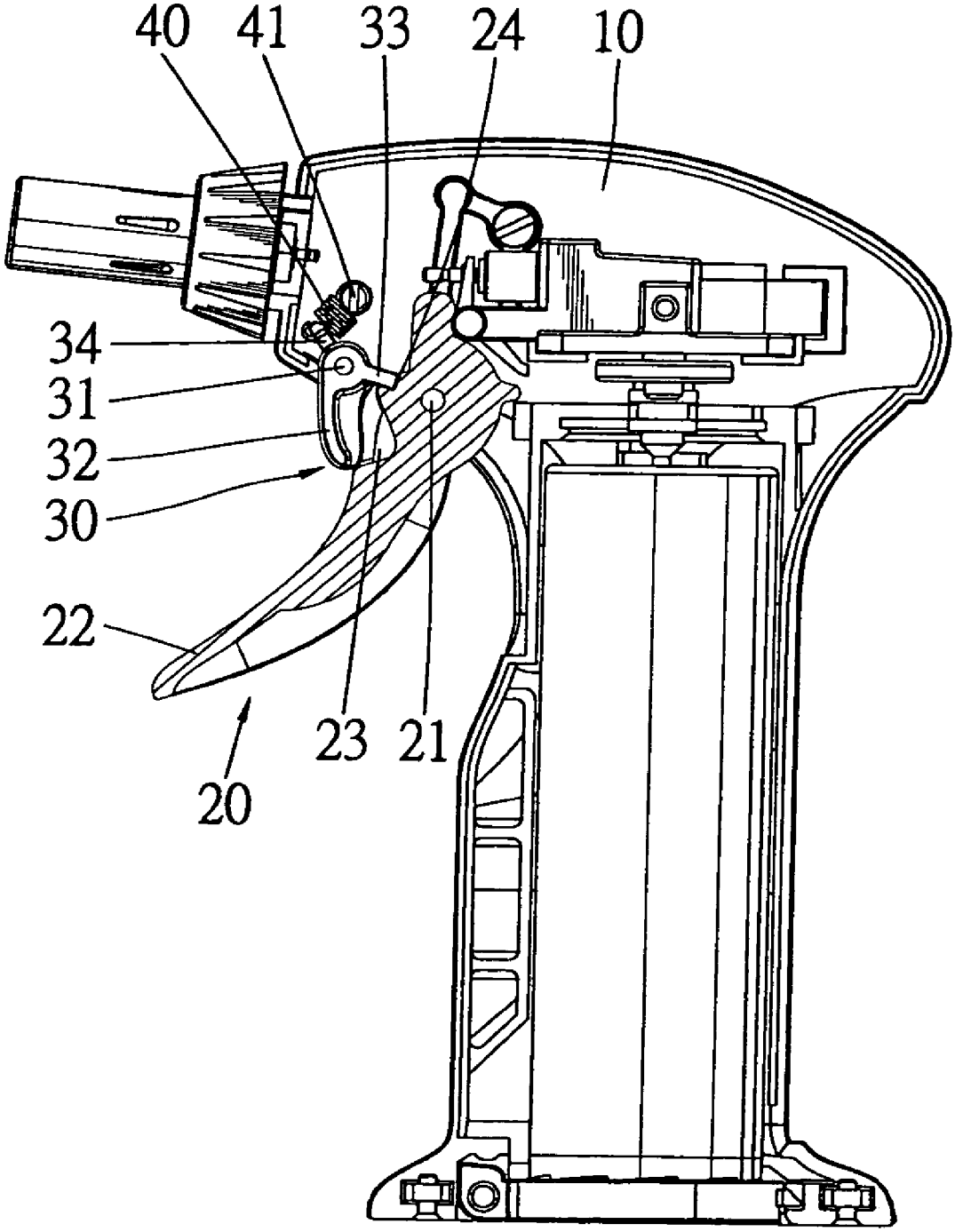
FIG. 3 is a cross-sectional view of the igniter shown in FIG. 1.

Referring to FIGS. 2 and 3, the trigger 20 includes two axles 21 formed near an end, a finger-contacting portion 22 formed near an opposite end, a first recess 24 defined therein near the axles 21 and a second recess 23 defined therein between the axles 21 and the finger-contacting portion 22. The axles 21 are pivotally connected to the interior of the igniter 10. Exposed from the igniter 10 is the finger-contacting portion 22 for contacting a user's finger.

The security element 30 includes two axles 31 formed near an end, a finger-contacting portion 32 formed near an opposite end, an abutment portion 33 formed thereon corresponding to the first recess 23 and a connection portion 34 formed thereon near the axles 31. The axles 31 are pivotally connected to the interior of the igniter 10. Exposed from the igniter 10 is the finger-contacting portion 32 for contacting the finger. The connection portion 34 defines an aperture 35.

A spring 40 includes an end hooking a rod 41 formed on the interior of the igniter 10 and an opposite end inserted in the aperture 35 of the connection portion 34 of the security element 30. The spring 40 is a tension spring for pivoting the finger-contacting portion 32 of the security element 30 from the finger-contacting portion 22 of the trigger 20 and at the same time keeping the abutment portion 33 of the security element 30 in the recess 24 of the trigger 20.

Normally, the abutment portion 33 of the security element 30 is put in the first recess 24 of the trigger 20 so that the trigger 20 cannot be pivoted relative to the igniter 10. Therefore, the igniter 10 will not be actuated by mistake because of accidental operation of the trigger 20.

Figure 4:
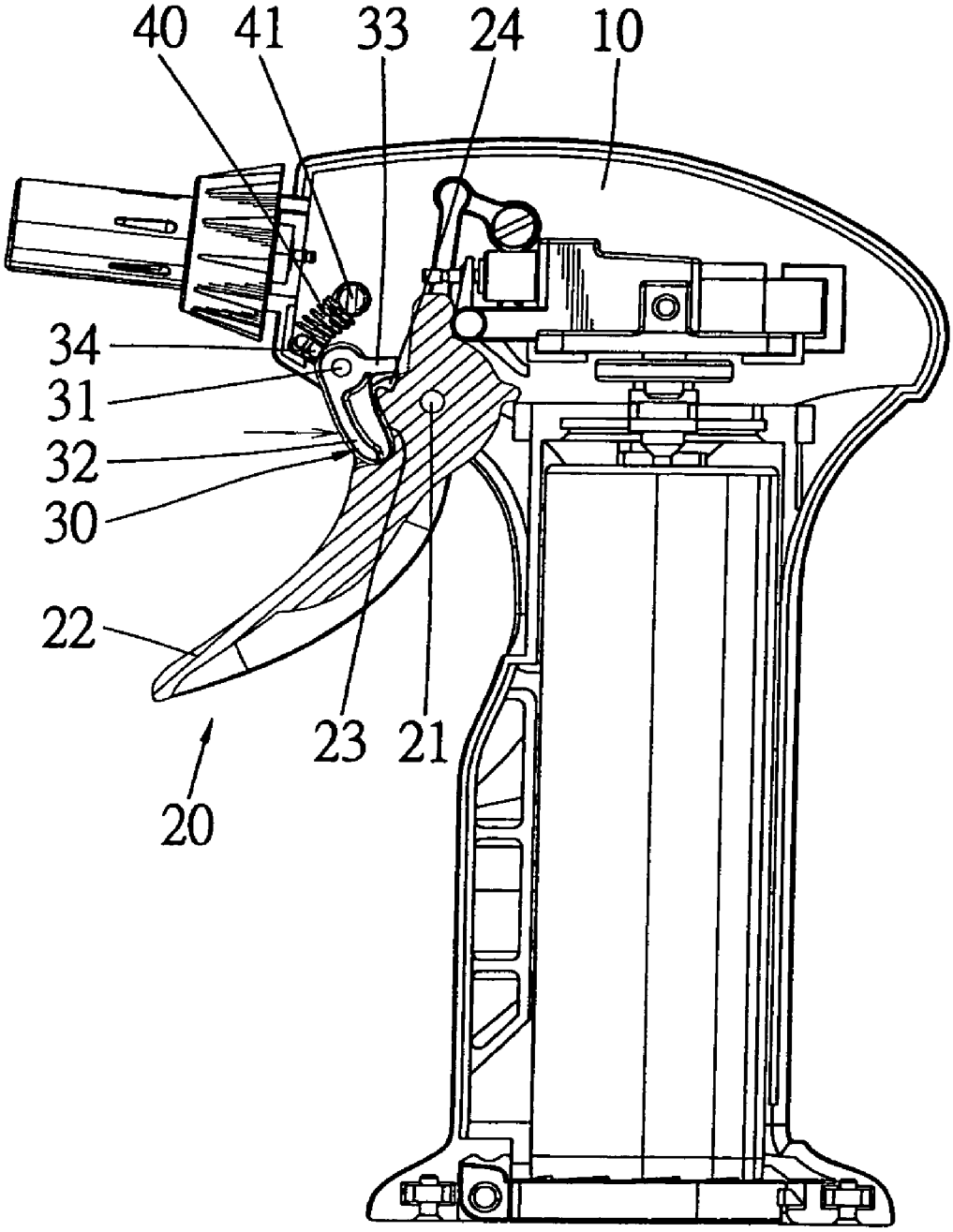
FIG. 4 is similar to FIG. 3 but shows the igniter in another position.

Referring to FIG. 4, wishing to actuate the igniter 10, the user presses and pivots the finger-contacting portion 32 of the security element 30 toward the trigger 20. Synchronously, the abutment portion 33 of the security element 30 is moved from the first recess 24 of the trigger 20. Thus, the trigger 20 is free for pivotal movement. The finger-contacting portion 32 of the security element 30 is put in second recess 23 of the trigger 20 so that the finger-contacting portion 32 of the security element 30 and the finger-contacting portion 22 of the trigger 20 form a smooth surface in order to provide a nice feel for the user. If the user continues to press the finger-contacting portion 32 of the security element 30, the force will be transferred to the axles 21 of the trigger 20 for contact of the security element 30 with the trigger 20. Hence, there will be no torque on the trigger 20, i.e., the trigger 20 cannot be pivoted. The user cannot actuate the igniter 10 while pressing the security element 30 only.

Figure 5:
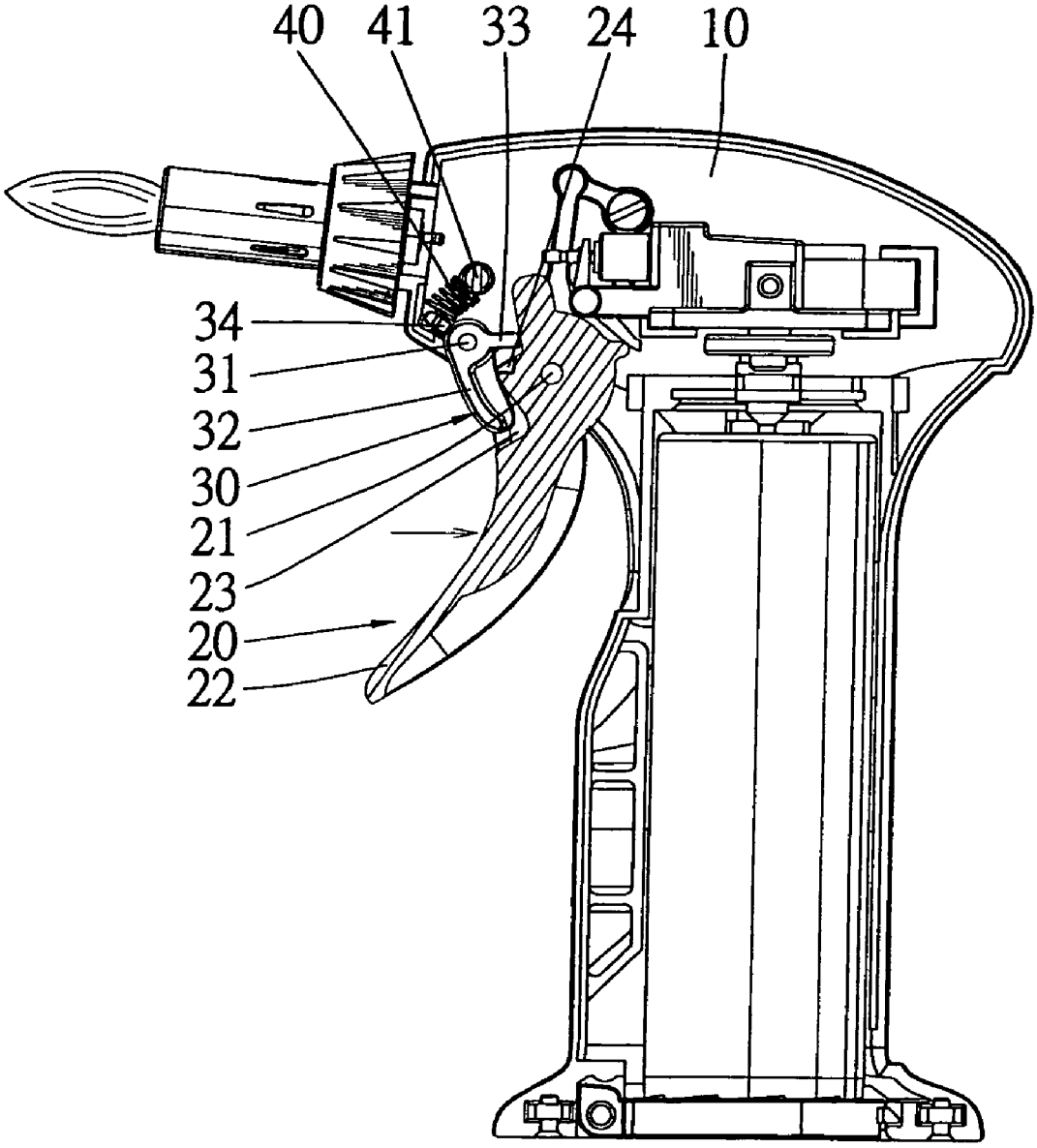
FIG. 5 is similar to FIG. 4 but shows the igniter in another position.

Referring to FIG. 5, when the security element 30 is pressed against the trigger 20, the trigger 20 is free for pivotal movement. The user can press and pivot the finger-contacting portion 22 of the trigger 20, thus pivoting the security element 30 and the trigger 20 in the same direction for actuating the igniter 10.

The igniter 10 of the present invention exhibits several advantages.

Firstly, it is secure, i.e., accidental pivotal movement of the trigger 20 is avoided. This is because the security element 30 is engaged with the trigger 20 normally. The security element 30 is engaged with the trigger 20 firmly, because the abutment portion 33 of the former is put in the first recess 24 of the latter. The use of the spring 40 keeps the abutment portion 33 of the security element 30 in the first recess 24 of the trigger 20.

Secondly, it is convenient. Since the security element 30 and the trigger 20 are located next to each other and can be pivoted in the same direction, pivotal movement of the former and pivotal movement of the latter can be conducted in a smooth sequence.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. An igniter comprising:

a trigger pivotally connected to the igniter about a trigger pivot axis for actuation thereof; and a security element pivotally connected to the igniter about an element pivot axis spaced from the trigger pivot axis and from the trigger, wherein the security element normally locks the trigger and can be pivoted in order to set the trigger free for pivotal movement, wherein pivoting of the security element and pivotinig of the trigger can be done in a smooth sequence, wherein the trigger is pivotally connected to the igniter near an end and formed with a finger-contacting portion near an opposite end, wherein the security element is pivotally connected to the igniter near an end and formed with a finger-contacting portion near an opposite end, wherein the finger-contacting portion of the trigger comprises a recess for receiving the finger-contacting portion of the security element.

2. The igniter according to claim 1 wherein the trigger comprises two axles formed thereon near an end and pivotally installed in the igniter, with the two axles defining the trigger pivot axis.

3. The igniter according to claim 2 wherein the trigger comprises a finger-contacting portion formed thereon near an opposite end.

4. The igniter according to claim 1 wherein the security element comprises two axles formed thereon near an end and pivotally installed in the igniter, with the two axles defining the element pivot axis.

5. The igniter according to claim 4 wherein the security element comprises a finger-contacting portion formed thereon near an opposite end.

6. The igniter according to claim 1 wherein the security element comprises an abutment portion for abutting the trigger, thus avoiding accidental pivotal movement of the trigger.

7. The igniter according to claim 6 wherein the trigger defines a recess for receiving the abutment portion of the security element, with the abutment portion received in the recess avoiding accidental pivotal movement of the trigger.

8. The igniter according to claim 1 comprising a spring provided between a portion of the igniter and the security element in order to keep the security element locking the trigger.

9. The igniter according to claim 8 wherein the security element comprises a connection portion connected to the spring.

10. The igniter according to claim 9 wherein the connection portion of the security element comprises an aperture in which an end of the spring is put.

11. The igniter according to claim 8 comprising a rod formed in the igniter and hooked by an end of the spring.

12. The igniter according to claim 8 wherein the spring is a tension spring.

* * * * *